United States Patent [19]

Shidara

[11] 4,400,824

[45] Aug. 23, 1983

[54] X-RAY TUBE WITH SINGLE CRYSTALLINE COPPER TARGET MEMBER

[75] Inventor: Tokihiko Shidara, Yokohama, Japan

[73] Assignee: Tokyo Shibaura Denki Kabushiki Kaisha, Kawasaki, Japan

[21] Appl. No.: 233,432

[22] Filed: Feb. 11, 1981

[30] Foreign Application Priority Data

Feb. 12, 1980 [JP] Japan ..... 55-14763
Feb. 12, 1980 [JP] Japan ..... 55-14764

[51] Int. Cl.[3] ..... H01J 1/38; H01J 35/08

[52] U.S. Cl. ..... 378/141; 378/143; 313/311

[58] Field of Search ..... 29/25.17, 25.18, 25.13; 378/119, 121, 141, 143, 144; 313/311, 218

[56] References Cited

U.S. PATENT DOCUMENTS

| | | | |
|---|---|---|---|
| 2,340,500 | 2/1944 | Zunick | 29/25.18 |
| 2,816,241 | 10/1957 | Zunick et al. | 378/121 |
| 2,886,724 | 5/1959 | Steer | 378/141 |
| 3,160,779 | 12/1964 | Zunick | 378/121 |
| 3,209,197 | 9/1965 | Ahsmann et al. | 313/218 |

*Primary Examiner*—Palmer C. Demeo
*Assistant Examiner*—Sandra L. O'Shea
*Attorney, Agent, or Firm*—Cushman, Darby & Cushman

[57] ABSTRACT

An electron tube having a sealed envelope, a cathode disposed inside said sealed envelope, an anode sealed to part of the sealed envelope, and a target member cast to the surface of the substrate, wherein at least the part of the anode which adjoins the target member is substantially made of single crystalline copper.

4 Claims, 9 Drawing Figures

X-RAY TUBE WITH SINGLE CRYSTALLINE COPPER TARGET MEMBER

The present invention relates to an electron tube having an improved anode and to a method for manufacturing the same.

Copper materials are used in many fields. For example, copper is used as an electrode material for electron tubes, particularly as the material for the anodes of electron tubes due to the excellent thermal conductivity and electrical conductivity of the material. For example, the anode structures of an X-ray tube, transmission tube, discharge tube, klystron and travelling-wave tube are made of a copper material. In this field, anode is subjected to high temperatures, and to rapid rises and drops in temperature due to repetition of the operation. For this reason, during the use of the electron tube, a grain boundary cracking may be caused or the thermal conductivity of copper may be degraded by the growth of crystal grains.

In general, a stationary anode X-ray tube has a construction as shown in FIG. 1 wherein an anode base 2 enclosed by a metal hood 3 is arranged at one side of an envelope 1 of glass. At the other side of the envelope 1, in opposition to the anode 2, is a cathode filament 5 mounted in a groove at the front end of a focusing cup 6. The cathode filament 5 is connected to a filament terminal 7. The focusing cup 6 is supported by a support 8 mounted to the envelope 1.

In such an X-ray tube, during the operation, the cathode filament 5 emits electrons when heated by a current supplied by the filament terminal 7. These electrons are focused by the cup 6 and accelerated by a high voltage applied to the anode base 2. The electrons then collide with a target 4 with a desired distribution and energy. X-rays are emitted from the target 4, and are irradiated outward through a window 9 and envelope 1.

The target is generally made of a material which is hard to melt such as tungsten since it receives the colliding impact of the electrons from the cathode filament 5 and is heated to a high temperature. The anode base 2 is made of copper which has good thermal conductivity for dissipating the heat from the target 4. In order to effectively dissipate the heat from the target 4 to the anode base 2, the target 4 and the anode base 2 must be adhered well.

In order to satisfy these requirements, vacuum casting is most frequently performed for mounting the target 4 to the anode base 2. According to this method, the target 4 is fixed in a heating cylinder (not shown), and copper supplied therein is melted under a high vacuum or in a low pressure reducing atmosphere, and at a high temperature to melt and adhere the target 4 with the base. The anode thus obtained is gradually cooled in a vacuum, so that the copper crystal grains of the anode tend to become large in grain size.

The X-ray tubes are recently required to be of large load type and the electric load is increasing more and more. With such an X-ray tube, the temperature rise of the target is expected to be significant. In order to compensate for this, a plurality of drilled holes 12 are formed in the anode base 2 to the proximity of the target 4, and cooling oil is sprayed to the drilled holes 12 from fitting nozzles 10 during the operation of the X-ray tube. Oil is forcibly cooled by being circulated through a heat exchanger for cooling effects. Despite of this fact, such a high load X-ray tube tends to have a short service life which is caused by the interruption of vacuum in the initial period of use. The present inventor has made extensive studies to eliminate these problems and has found that this interruption of vacuum is attributable to the cracking of the grain boundary of the anode base. As has been already described, the grain tends to have greater size when it is gradually cooled under the vacuum in the manufacturing method of a high quality anode and excellent thermal conductivity with excellent adhesion of the target. As shown in FIG. 2, dendritic grain boundaries 13 are formed and they extend from the drilled holes 12 from the atmospheric side to the target 4. When a high load of about 4 kW is intermittently exerted in a focusing area of about 50 $mm^2$ with a high load X-ray tube, the temperature of the surface of the target 4 instantaneously rises to about 1,000° C. and the temperature of the anode base 2 behind the target 4 rises to about 700° C. In this manner, the anode base 2 near behind the target 4 receives the intermittent heat cycle of about 700° C. during the use of the high load X-ray tube, and a large thermal stress is exerted to it. This thermal stress is so large that recrystallization is observed at the part of the target rear side or along the grain boundaries 13 in the heat cycle of 100 to 200 hours. The grain boundaries 13 of dendrite which are also mechanically weak form cracks in the initial period of use, interrupting the vacuum inside the envelope 1. When the drilled holes 12 are formed in the anode base 2 for improving the cooling effects, the vacuum interruption is promoted. With such a high load X-ray tube, grain boundary cracking is caused by the intermittent heat stress, resulting in defective leakage and short service life during the initial period of use. It has been confirmed, according to the studies made by the present inventor, that the amount of the molten material gas impurity (oxygen, nitrogen, and so on) at the crystal grain part during the manufacture of the anode base is as small as several ppm. It is thus seen from this that the grain boundary defects due to the presence of the impurity is not the cause of the grain boundary cracking.

It is, therefore, the primary object of the present invention to provide an electron tube having an improved anode in the crystal structure of the copper material and of high quality and long service life.

It is another object of the present invention to provide a method for manufacturing such an anode of electron tube.

According to an aspect of the present invention, there is provided an electron tube having a sealed envelope, a cathode disposed inside said sealed envelope, and an anode sealed to part of said sealed envelope, characterized in that at least part of said anode is substantially made of single crystalline copper.

According to another aspect of the present invention, there is also provided a method for manufacturing an anode of an electron tube comprising the steps of arranging a container holding copper mass in a heating furnace placed under a reduced pressure, heating the copper mass in a low pressure reducing gas atmosphere, melting the copper mass, exhausting said reducing gas, gradually cooling the molten copper at a rate of 5° C./min or less within a solidifying and crystallizing temperature range, and taking the copper out of said container to form it into a predetermined shape of said anode.

This invention can be more fully understood from the following detailed description when taken in conjunction with the accompanying drawings, in which.

According to the present invention, an electron tube which has an anode sealed to a part of a sealed envelope and is interposed between the outside air and the inner atmosphere of the envelope is so constructed that at least part of the anode is made of single crystalline copper, thereby preventing cracking due to the formation of grain boundaries of the anode as well as the degradation in the thermal conductivity due to the growth of crystal grains.

Figure 1:
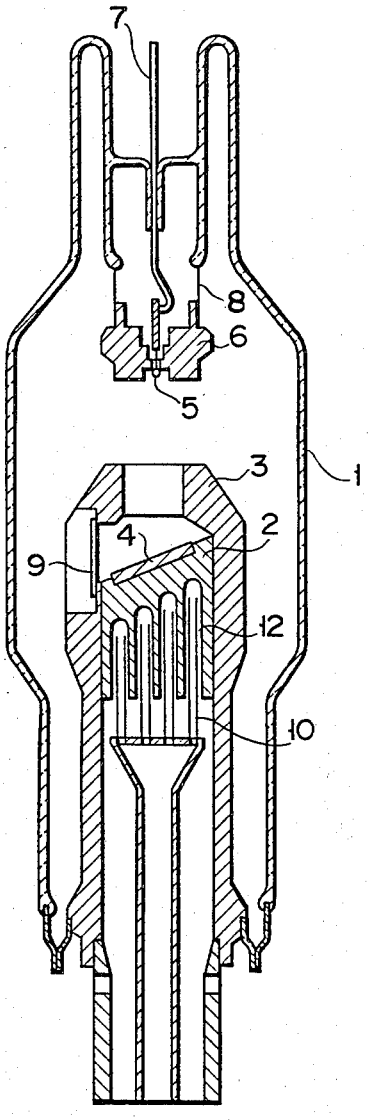
FIG. 1 is a sectional view of an X-ray tube.

When the present invention is applied to an X-ray tube, referring to FIG. 1, the part of the anode base 2 which comes in contact with the target is substantially made of single crystalline copper.

Single crystalline copper is of the face-centered cubic lattice structure and is symmetrical about the crystallographic axes, so that it does not have an anisotropy in the thermal conductivity and the thermal expansion coefficient. For this reason, the X-ray tube anode made of single crystalline copper has thermal conductivity characteristics superior to those of an anode of a polycrystalline copper. Furthermore, the grain boundary cracking caused by the thermal stress of the conventional X-ray tube anode may be completely eliminated. The adhesion with the target member is also practically acceptable. Therefore, an anode for high load X-ray tube of high quality and long service life is obtained.

Figure 4:
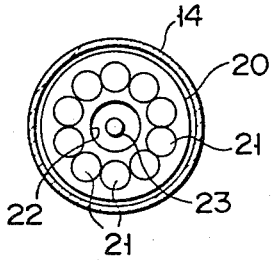
FIG. 4 is a cross sectional view of the vacuum container of FIG. 3.
Figure 5:
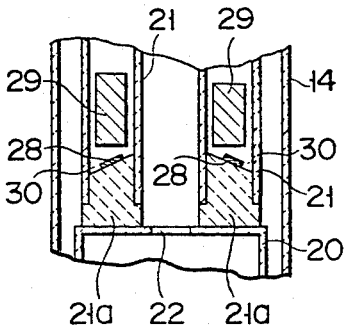
FIG. 5 is a partial, longitudinal sectional view of the vacuum container of FIG. 3.
Figure 3:
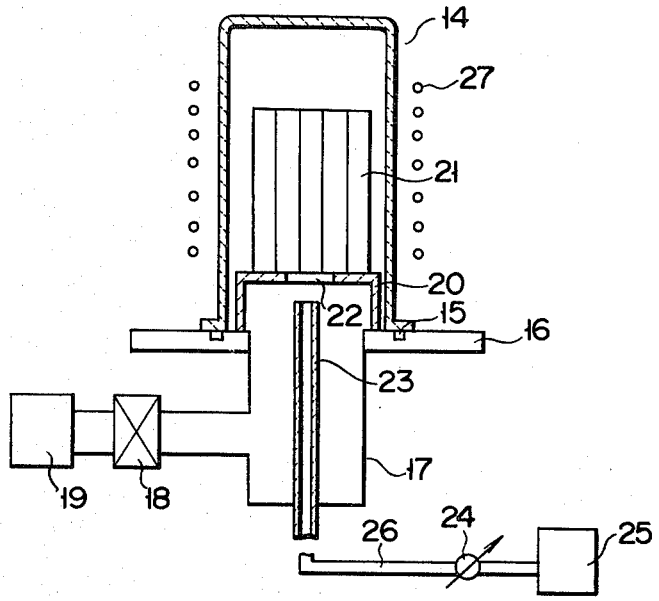
FIG. 3 is a schematic view of an apparatus for manufacturing the anode of the present invention.

The method for manufacturing the anode of the electron tube according to the present invention will be described with reference to the embodiments wherein the method is applied to the anode of an X-ray tube. FIG. 3 shows an apparatus used in the method of the present invention, FIG. 4 is a cross sectional view of a vacuum container 14, and FIG. 5 is a partial view of the longitudinal section of the vacuum container 14. In this apparatus, a heating vacuum container 14 of quartz bell jar type is placed on a flange 16 through a packing 15. The flange 16 is connected to an oil rotary pump 19 through an exhaust conduit 17 and a valve 18. A plurality of casting containers, that is, heating cylinders 21 of a material which is hard to melt such as graphite are arranged in a circle inside the vacuum container 14 through a hollow, cylindrical biscuit base 20 placed on the flange 16. Reference numeral 21*a* denotes a bottom part of the cylindrical body 21 which is also made of graphite and is integrally formed therewith. A gas exhaust hole 22 is formed in the top of the biscuit base 20, and several exhaust holes (not shown) are formed in its side. A small tube 26 is arranged such that its one end has a hydrogen inlet nozzle 23 protruding and opening into the hollow biscuit base 20 and its other end is connected to a high purity hydrogen gas source 25 through microleak valve 24. Casting is performed, for example, by a high frequency induction heating coil 27.

Figure 2:
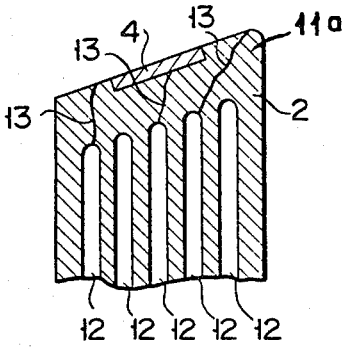
FIG. 2 PRIOR ART
FIG. 2 is a sectional view of the anode of a conventional X-ray tube.

As shown in FIG. 5, within the cylinder 21 to be heated are arranged a target member 28 of a predetermined material such as tungsten and a copper member 29. These heating cylinders 21 are arranged in a circle. These heating cylinders 21, that is, the casting containers have recesses at their bottoms. In this embodiment, the bottoms of these containers are tapered to define tapered edge parts 30 as recesses. These tapers are formed substantially in correspondence with the tapered angle of the target surface of the X-ray tube anode. These recesses are arranged in the radial direction with respect to the center of the vacuum container 14 and the biscuit base 20, that is, arranged to face outward. Thus, the taper edge parts 30 corresponding to the taper edge parts (11*a* in FIG. 2) of the finished cast anode are aligned outwardly of the cylinders.

The single crystalline material for the X-ray tube anode base is obtained by such an apparatus. The points of method may be summarized as follows. First point is to reduce to purify the casting member with high purity hydrogen gas.

The second point is to cool the molten copper gradually around the solidification and crystallization temperature (1,083° C.) of the molten copper material. A cooling speed is very slow to prevent undercooling, to suppress formation of the nuclei and to facilitate growth of crystals. The third point is to facilitate a formation of nucleus and growth of the crystals from the taper edge part 30. That is, this point is to provide the conditions similar to the case wherein a seed crystal is supplied as a nucleus to solidify the molten copper thereon. In this case, the particular shape of the X-ray tube anode is utilized and the inner space taper edge part 30 of the casing container corresponding to the taper edge part of the finished cast anode is aligned to the radial direction of the vacuum container.

An example of the method for manufacturing the X-ray tube stationary anode of the present invention will now be described.

(A) As shown in FIGS. 3 to 5, under the condition that the heating cylinders 21 enclosing the target members and the copper members are arranged, the oil rotary pump 19 is operated to open the valve 18 to evacuate the vacuum container 14 to $10^{-1}$ to $10^{-2}$ Torr.

(B) While the oil rotary pump 19 is being operated, the microleak valve 24 is opened to introduce hydrogen to adjust the internal pressure of the vacuum container to 8 to 10 Torr. In this manner, the hydrogen gas replaces the impurity gas inside the vacuum container 14 for cleaning and a circulation path for exhausting it is formed.

Figure 6:
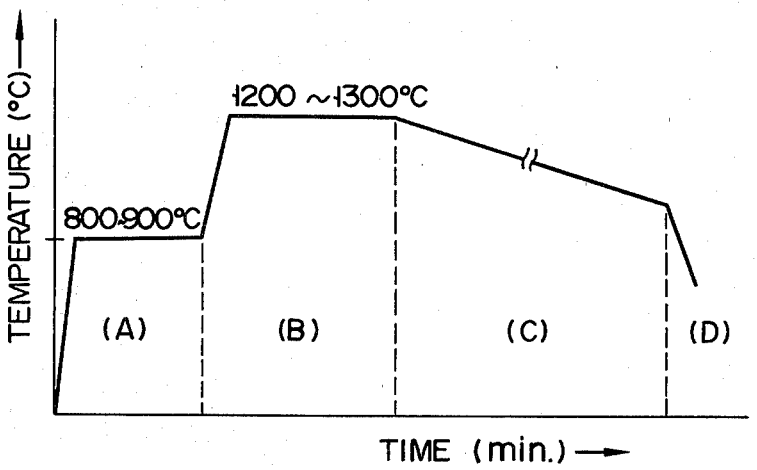
FIG. 6 is a graph illustrating the temperature cycle of the manufacturing method of the anode of the present invention.

(C) According to the heating step shown in FIG. 6, the heating cylinders 21 are heated by the high frequency induction heating coil 27 arranged outside the vacuum container 14.

The melting and gradual cooling process shown in FIG. 6 may be divided into the three steps, as shown in the figure.

The step (A) is the predegassing step according to which the temperature is held at 800° to 900° C. for reducing and cleaning the heating cylinders 21 and other members. A sufficient time must be allowed in order to remove the impurities deposited on the surfaces of the tungsten target members and the copper members. By this step, the formation of seed crystals in other parts than the taper edge part, which tends to accelerate the speed of formation of nuclei in a solidification and crystallization step may be suppressed.

In the step (B), after the members are cleaned, the heating temperature is raised to the melting and casting temperature of 1,200° to 1,300° C. Although emission of gas from the anode material is significant, the oxygen in the molten copper may be positively removed in the form of water by the hydrogen gas introduced for 5 to 10 minutes. When the introduction of hydrogen is terminated thereafter, the hydrogen incorporated in the anode material is immediately exhausted. After the exhaustion of hydrogen, the interior of the container is adjusted to a vacuum of about $10^{-2}$ Torr or less.

The step (C) is the most important step for obtaining single cyrstalline material. In this step, the gradual cooling is performed at a cooling rate of 5° C. or less per minute within the range of the solidification and crystallization temperature (1,083° C.) of copper. In this step, care is taken to avoid undercooling, to reduce the formation of nuclei to substantially zero, and to facilitate the crystallization. The gradual cooling may be performed by gradually lowering the high frequency output.

Since the part 30 corresponding to the taper edge part of the finished casted anode having the particular shape of the X-ray tube anode is aligned outwardly of the circumference, when the cylindrical vacuum container is subjected to temperature drop, the periphery undergoes the temperature drop slightly faster than the central part. Furthermore, since the taper edge part is smaller than the members in heat capacity, it undergoes temperature drop faster to provide the nucleus. Due to this, crystallization is initiated from this part, reaches the vicinity of the target members, and spreads to the overall anode to provide the single crystalline structure with certainty. The present inventor has succeeded to manufacture an anode comprising an anode base of single crystalline material having 38 mm diameter, 100 mm length and about 70° tapered angle (angle with respect to the central axis), and the tungsten target member 25 mm in diameter and 2 mm in thickness. The reproducibility was satisfactory when the tapered angle was about 80° or less.

(D) After solidification and crystallization, rapid cooling with nitrogen gas at about 900° C. or less is performed in the step (D). This helps to shorten the overall method. After cooling, the cylinders are taken out of the vacuum container 14, and the cast anodes are taken out of the cylinders 21 and subjected to final processing to form them into a desired anode shape.

The pressure of the introduced hydrogen must be at least several Torr in order to prevent incorporation of the oxidizing gas into the anode material and to provide the reducing atmosphere. It is preferable to limit this hydrogen pressure to several tenths Torr at most, considering the safe operation of the oil rotary pump, the consumption amount of hydrogen, and formation of voids by the impurity gas in the molten copper.

Although the speed of gradual cooling is better as it is slower, 5° C. is the upper limit from the perspective of industrial application and mass-production.

Figure 7:
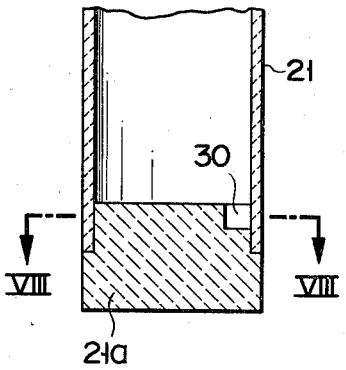
FIG. 7 is a longitudinal sectional view of the main part according to another embodiment of the casting container of FIG. 3.
Figure 8:
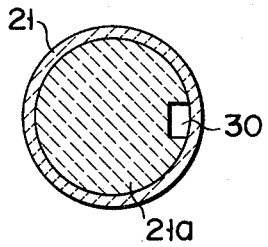
FIG. 8 is a sectional view along the line VIII—VIII of FIG. 7.
Figure 9:
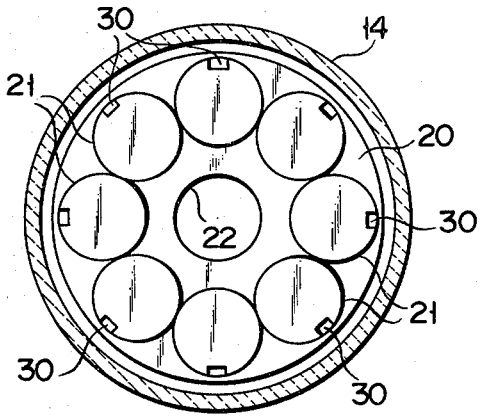
FIG. 9 is a cross sectional view of the vacuum container housing a plurality of the casting containers.

In an embodiment shown in FIGS. 7 to 9, a hole-like recess 30 is formed at the periphery of the bottom in the casting container 21 for holding copper raw material. These containers 21 have recesses 30 at their flat bottoms and these recesses are made to face outward when the containers are arranged inside the heating vacuum container 14. With an embodiment which uses such casting containers, the recesses of this embodiment correspond to the taper edge parts of the former embodiment so that the molten copper starts crystallizing from the recesses and gradually spreads to the entirety to provide single crystalline copper material.

Single crystalline copper bodies may be obtained with excellent reproducibility by using the casting containers having hole-like recesses as shown in FIGS. 7 to 9 at parts of the bottoms of the inner spaces, positioning these containers such that the recesses are oriented outwardly of the heating vacuum container, that is, at the lowest temperature distribution during the temperature drop, and by performing gradual cooling. The X-ray tube may be accomplished if the surrounding part of the target member, that is, the vicinity of the target surface of the anode base is substantially of the single crystalline structure. Accordingly, the overall anode need not be of the single crystalline structure.

The X-ray tube stationary anode of single crystalline copper thus obtained was proved to have the single crystalline structure by chemical etching, X-ray diffractiometry, and Laue photograph.

In the above embodiments, 100 single crystalline copper rods of 38 mm diameter and 10 mm length were obtained at the same time.

When the target 28 is eliminated, single crystalline copper may be obtained.

According to the present invention, an anode of an X-ray tube may be obtained which has excellent thermal conductivity, completely prevents crystal grain cracking, and provides excellent adhesion with the target member. By using such an anode, an X-ray tube of high quality, long service life, and high load may be obtained.

Further, single crystalline copper may be used suitably as the anode material of other high power electron tubes than the X-ray tube.

What is claimed is:

1. An X-ray tube comprising a sealed envelope, a cathode disposed inside said sealed envelope, and an anode sealed to part of said sealed envelope and comprising an anode substrate of copper and a target member fixed to a surface of said anode substrate, at least that portion of said anode substrate which adjoins said target member being substantially made of single crystalline copper.

2. An X-ray tube according to claim 1, wherein said anode substrate has holes for allowing flow of a cooling medium therethrough.

3. An X-ray tube as in claim 1, wherein said target member is cast in the surface of said substrate.

4. An X-ray tube as in claim 1, wherein said anode substrate has interior passages for circulating a cooling fluid.

* * * * *